US009273266B2

(12) United States Patent
Greaves et al.

(10) Patent No.: US 9,273,266 B2
(45) Date of Patent: Mar. 1, 2016

(54) NON-AROMATIC BASED ANTIOXIDANTS FOR LUBRICANTS

(75) Inventors: Martin R. Greaves, Hirzel (CH); Evelyn A. Zaugg-Hoozemans, Horgen (CH); Timothy Morley, Horgen (CH)

(73) Assignee: Dow Global Technologies LLC

( * ) Notice: Subject to any disclaimer, the term of this patent is extended or adjusted under 35 U.S.C. 154(b) by 95 days.

(21) Appl. No.: 13/818,811

(22) PCT Filed: Sep. 20, 2011

(86) PCT No.: PCT/US2011/052312

§ 371 (c)(1), (2), (4) Date: Feb. 25, 2013

(87) PCT Pub. No.: WO2012/040174

PCT Pub. Date: Mar. 29, 2012

(65) Prior Publication Data

US 2013/0288939 A1 Oct. 31, 2013

Related U.S. Application Data

(60) Provisional application No. 61/386,149, filed on Sep. 24, 2010.

(51) Int. Cl.

| | |
|---|---|
| ***C10M 169/04*** | (2006.01) |
| ***C10M 133/10*** | (2006.01) |
| *C10M 159/12* | (2006.01) |
| *C10M 129/00* | (2006.01) |
| *C10M 141/02* | (2006.01) |
| *C10M 141/06* | (2006.01) |

(52) U.S. Cl.

CPC ..... *C10M 133/10* (2013.01); *C10M 169/04* (2013.01); *C10M 129/00* (2013.01); *C10M 141/02* (2013.01); *C10M 141/06* (2013.01); *C10M 159/12* (2013.01); *C10M 2203/1025* (2013.01); *C10M 2203/1065* (2013.01); *C10M 2205/026* (2013.01); *C10M 2205/0285* (2013.01); *C10M 2207/026* (2013.01); *C10M 2209/1033* (2013.01); *C10M 2209/1045* (2013.01); *C10M 2209/1055* (2013.01); *C10M 2209/1065* (2013.01); *C10M 2209/1085* (2013.01); *C10M 2215/042* (2013.01); *C10M 2215/044* (2013.01); *C10M 2215/064* (2013.01); *C10N 2220/021* (2013.01); *C10N 2220/022* (2013.01); *C10N 2230/02* (2013.01); *C10N 2230/10* (2013.01); *C10N 2240/04* (2013.01); *C10N 2240/08* (2013.01); *C10N 2240/10* (2013.01); *C10N 2240/30* (2013.01)

(58) Field of Classification Search

CPC ..... C10M 133/10
USPC ..... 508/561
See application file for complete search history.

(56) References Cited

U.S. PATENT DOCUMENTS

| | | | | |
|---|---|---|---|---|
| 3,535,378 | A | 10/1970 | Cross | |
| 4,116,846 | A | 9/1978 | Sato et al. | |
| 4,173,542 | A | 11/1979 | Sato et al. | |
| 5,096,933 | A | 3/1992 | Volkert | |
| 5,114,988 | A | 5/1992 | Gagnon et al. | |
| 5,336,420 | A | 8/1994 | Horodysky et al. | |
| 5,521,237 | A | 5/1996 | Seltzer et al. | |
| 5,602,190 | A | 2/1997 | Lamberts et al. | |
| 5,844,115 | A | 12/1998 | Moody et al. | |
| 5,895,792 | A | 4/1999 | Rotermund et al. | |
| 6,316,513 | B1 | 11/2001 | McCullough et al. | |
| 7,413,583 | B2 | 8/2008 | Langer et al. | |
| 2005/0009967 | A1 | 1/2005 | Zahalka et al. | |
| 2005/0069997 | A1 | 3/2005 | Adkesson et al. | |
| 2005/0181958 | A1 | 8/2005 | Carey et al. | |
| 2008/0312113 | A1 | 12/2008 | Beatty et al. | |
| 2009/0118151 | A1 * | 5/2009 | Sasaki et al. | 508/545 |

FOREIGN PATENT DOCUMENTS

| | | | | |
|---|---|---|---|---|
| DE | 214620 | A1 | | 10/1984 |
| DE | 251148 | A1 | | 11/1987 |
| EP | 208512 | A1 | | 1/1987 |
| JP | 09316482 | A | * | 12/1997 |
| JP | 2003022281 | | | 1/2006 |
| JP | 2006083378 | | | 6/2006 |
| JP | 2006143937 | | | 6/2006 |
| JP | 2006257335 | | | 9/2006 |
| JP | 2007154035 | | | 6/2007 |
| JP | 2008127444 | | | 5/2008 |
| WO | 93/18118 | | | 9/1993 |
| WO | 00/23648 | | | 4/2000 |
| WO | 00/31162 | | | 6/2000 |
| WO | 02/02664 | A1 | | 1/2002 |
| WO | 2008/094238 | A1 | | 8/2008 |
| WO | 2008/094239 | A1 | | 8/2008 |
| WO | 2008/094963 | A1 | | 8/2008 |
| WO | 2010/009189 | A1 | | 1/2010 |

* cited by examiner

OTHER PUBLICATIONS

Sousa, et al., Effect of Cyclohexylene Bridges on the Metal Ion Size Based Selectivity of Ligands in Aqueous Solution, Inorg. Chem., 1991, vol. 30, pp. 3525-3529.

*Primary Examiner* — Taiwo Oladapo

(57) ABSTRACT

A lubricant composition comprises a cycloaliphatic amine alkoxylate and a base oil selected from (a) a polyalkylene glycol; (b) a polyalphaolefin; (c) a naphthenic compound; and (d) combinations thereof; provided that the cycloaliphatic amine alkoxylate and the base oil are miscible. The lubricant may exhibit a viscosity change at 40° C. of less than 5 percent (%) after 13 days at 120° C. in dry air, indicating significant thermoxidative stability with minimal or no aromatic content, thereby enabling use of Groups II and III base oils, in particular, without reduced toxicity and/or quality concerns as compared with Group I base oil lubricants.

8 Claims, No Drawings

NON-AROMATIC BASED ANTIOXIDANTS FOR LUBRICANTS

CROSS-REFERENCE TO RELATED APPLICATIONS

This is a §371 application of PCT International Patent Application Number PCT/US2011/052312 filed Sep. 20, 2011, and claims priority from U.S. provisional application Ser. No. 61/386,149, filed Sep. 24, 2010, each of which is incorporated herein by reference in its entirety.

BACKGROUND

1. Field of the Invention

The present invention relates to lubricant compositions and, more specifically, to methods and means of increasing the resistance of such compositions to oxidative degradation. The lubricant compositions of the invention may be particularly useful as hydraulic oils, gear oils, and compressor oils, particularly where aromatic compounds are of concern due to toxicity.

2. Background of the Art

In recent years the lubricants industry has made increasing use of solvent-refined and hydroprocessed hydrocarbon base oils. This is because traditional hydrocarbon, i.e., mineral oils (classified as Group I base oils by the American Petroleum Institute (API)) that have been used for many decades generally contain a high aromatic content, typically in the vicinity of 20 percent by weight (wt %). The high aromatic content tends to reduce the base oil quality by reducing its viscosity index and may also present toxicity issues, making these oils undesirable for some applications.

In view of the potential problems with aromatic content, the lubricants industry is currently moving toward greater use of Groups II and III base oils, which are base oils that achieve substantially reduced aromatic contents through hydro-processing methodologies. These base oils generally contain less than 10 wt % of aromatics and less than 300 parts per million (ppm) of sulfur. This level may then be reduced even further, to about 1 wt % aromatics and almost undetectable amounts of sulfur and nitrogen, by subjecting the Groups II and III base oils to post-treatment processes. Such processes may include hydrocracking and iso-dewaxing. Over the course of the next decade use of Group II and III oils is expected to grow rapidly as the industry transitions to these higher quality base oils.

Unfortunately, most lubricant applications require a certain minimum level of resistance to oxidative degradation. To achieve desirable levels, antioxidant additives may be used, and/or supplemental oils, containing naturally occurring antioxidants, may be included in the compositions. In most cases, antioxidants based on aromatic structures, such as aromatic amines and/or aromatic phenolic derivatives, are preferred for reasons of performance, cost, convenience, or a combination thereof. However, adding aromatic amines to Group II or III base oils vitiates, to at least some extent, the benefits derived from selecting a Group II or III base oil, instead of a Group I base oil, in the first place.

Because of the frequent conflict between achieving appropriate resistance to oxidative degradation and avoiding or reducing aromatic content, researchers in the lubricants field have continued to seek out new lubricant additives and/or formulations that offer thermoxidative stability without increased aromatic contents.

SUMMARY OF THE INVENTION

In one aspect the invention provides a lubricant composition comprising a cycloaliphatic amine alkoxylate and a base oil selected from (a) a polyalkylene glycol; (b) a polyalphaolefin; (c) a naphthenic compound; and (d) combinations thereof; provided that the cycloaliphatic amine alkoxylate and the base oil are miscible. In various embodiments the base oil may be a Group I, II or III base oil. The cycloaliphatic amine alkoxylate may be prepared by reacting an initiator selected from an aminocyclohexanealkylamine corresponding to Formula I or II; a cyclohexanediamine corresponding to Formula III or a diastereomeric form thereof; a methylene bis(cyclohexylamine) corresponding to Formula IV; a 1,3- or 1,4-bis(amino-methyl)cyclohexane corresponding to Formula V or VI; or a combination thereof; with an alkoxide selected from propylene oxide, butylene oxide, and combinations thereof; under conditions suitable to form a cycloaliphatic amine alkoxylate.

In another aspect the invention provides a method of making a lubricant composition comprising combining at least a cycloaliphatic amine alkoxylate and a base oil selected from (a) a polyalkylene glycol; (b) a polyalphaolefin; (c) a naphthenic compound; and (d) combinations thereof; under conditions such that the cycloaliphatic amine alkoxylate and the base oil are miscible; to form a lubricant composition. In preferred embodiments the lubricant composition exhibits a viscosity change of less than 5 percent (%) after 13 days at 120° C. in dry air, with viscosity testing carried out at 40° C. according to ASTM International's test method ASTM D7042.

DETAILED DESCRIPTION OF THE EMBODIMENTS

The invention enables design and preparation of lubricant formulations offering desirable and/or acceptable levels of thermoxidative stability, for a wide variety of uses. The formulations may also have the further advantage of including, as their base oils, Group II or Group III compounds that have reduced or eliminated aromatic content, when compared with the aromatic content of many Group I base oils that contain conventional aromatic-based antioxidants.

The antioxidant component, hereinafter "antioxidant additive," in the inventive formulations is at least one cycloaliphatic amine alkoxylate, or a mixture of cycloaliphatic amine alkoxylates. Such may be prepared by alkoxylating any of a variety of possible initiator compounds. For example, one suitable group of initiators is aminocyclohexanealkylamine compounds. Among these are compounds corresponding to Formula I:

(Formula I)

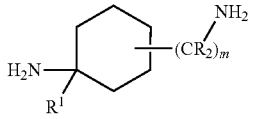

wherein $R^1$ is $C_1$-$C_4$ alkyl, and wherein each R is independently hydrogen or C1-C4 alkyl and m is an integer from 1 to 8. Each R group in Formula I is preferably independently hydrogen or methyl, and $R^1$ is preferably methyl. In Formula I, the —$(CR_2)_m$—$NH_2$ group may be ortho, meta or para to the amino group bonded directly to the cyclohexane ring. The —$NH_2$ and —$(CR_2)_m$—$NH_2$ groups may be in the cis- or trans-positions with respect to each other, and the cyclohexane carbon atoms may contain inert substituent groups in addition to the —$NH_2$, —$R^1$ and —$(CR_2)_m$—$NH_2$ groups shown. Preferred initiator compounds corresponding to Formula I include cyclohexanemethanamine or 1,8-diamino-p-menthane; and combinations thereof.

A second type of aminocyclohexanealkylamine initiator corresponds to Formula II:

(Formula II)

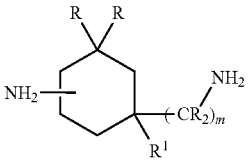

wherein R, $R_1$ and m are as defined with respect to Formula I. As in Formula I, each R group is preferably independently hydrogen or methyl and $R^1$ is preferably methyl and the —$(CR_2)_m$—$NH_2$ group may be ortho, meta or para to the amino group bonded directly to the cyclohexane ring. The —$NH_2$ and —$(CR_2)_m$—$NH_2$ groups may be in the cis- or trans-positions with respect to each other, and the cyclohexane carbon atoms may contain inert substituent groups in addition to the —$NH_2$, —$R^1$ and —$(CR_2)_m$—$NH_2$ groups shown. An especially preferred initiator compound that corresponds to Formula II is 5-amino-1,3,3-trimethylcyclohexanemethylamine. The production of this group of aminocyclohexanealkylamines is described in, e.g., WO 2008/094239, which is incorporated herein by reference in its entirety.

Initiators may also include cyclohexanediamines, such as those disclosed in, e.g., WO 2008/094963, which is incorporated herein by reference in its entirety. Among these are, for example, 1,2-, 1,3-, and 1,4-cyclohexanediamine; 2- and 4-methyl-cyclohexane-1,3-diamine; diastereoisomeric forms thereof; and combinations thereof. The 1,2-cyclohexanediamines may be represented by Formula III:

(Formula III)

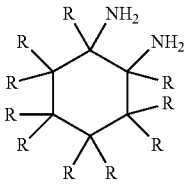

wherein each R is independently hydrogen or $C_1$-$C_4$ alkyl; and each R is preferably hydrogen or methyl. Examples of such initiators are 1,2-cyclohexanediamine, commercially available as DYTEK™ DCH 99 from Invista™, and 1,4-cyclohexanediamine, commercially available as 1,4-DCH from E.I. duPont de Nemours, Inc.

Another initiator to produce the cycloaliphatic amine alkoxylates useful in the present invention is a methylene bis(cyclohexylamine). A methylene bis(cyclohexylamine) initiator compound is a compound that contains a methylene group which is substituted with two cyclohexyl groups. The cyclohexyl groups may themselves be unsubstituted or inertly substituted. The methylene bis(cyclohexylamine) initiator compound can be represented by Formula IV:

(Formula IV)

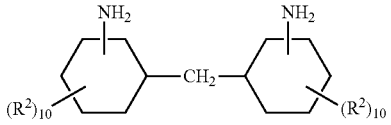

wherein each $R^2$ is hydrogen or an inert substituent. The $NH_2$ groups may be in the 2, 3 or 4 positions. The two $NH_2$ groups may be asymmetrically positioned with respect to the central methylene group. Preferred isomers are the 2,2'-, 4,4'-, and 2,4'-isomers. Each $R^2$ is preferably hydrogen, but any one or more of the $R^2$ groups may be an inert substitutent. An "inert" substituent is one that is not reactive with an alkylene oxide under the conditions of alkoxylation (as described hereinbelow). Inert substituents may include, in non-limiting example, hydrocarbyl groups, such as alkyl, alkenyl, alkynyl, aryl, aryl-substituted alkyl, and cycloalkyl;, ether groups; and tertiary amino groups. It is preferred that any substituent groups that may be present are $C_1$-$C_4$ alkyl. Among these are methyl, propyl, isopropyl, n-butyl, and isobutyl groups, with methyl being more preferred. If an inert substitutent group is present, it preferably has no more than one such group per cyclohexane ring. Most preferably, all R groups are hydrogen, and the compound is unsubstituted. One example of such initiator is 4,4'-methylenebis(2-methylcyclohexanamine), commercially available as LAROMIN™ C 260 from BASF.

Also suitable as an initiator compound for the cycloaliphatic amine alkoxylate is a 1,3- or 1,4-bis(aminomethyl) cyclohexane represented by either of the following Formula V or Formula VI:

(Formula V)

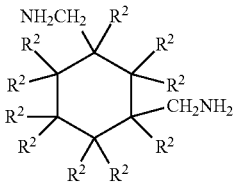

(Formula VI)

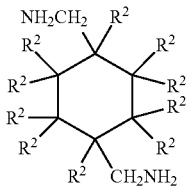

wherein each $R^2$ is as previously defined. An example of such initiator is 1,3-bis(amino-methyl)cyclohexane, commercially available as 1,3-BAC from, e.g., Mitsubishi Gas Chemical Co., Inc.

Alkoxylation of a selected initiator may be carried out using any methods or means known to those skilled in the art wherein the desired condensation may be effected. In general propylene oxide, butylene oxide, or combinations thereof are preferred as the alkoxylating agents, but ethylene oxide, pentylene oxide, and combinations of one or both of these with propylene oxide and/or butylene oxide may also be employed. Conditions of alkoxylation may conveniently range from a temperature ranging from 60 degrees Celsius (° C.) to 200° C., preferably 100° C. to 150° C.; a pressure ranging from approximately 1 standard atmosphere (atm) to 5 atm (~101 kPa to ~505 kPa); and a time ranging from 1 hour (h) to 12 h, preferably from 4 h to 8 h. An appropriate acid or alkaline alkoxylation catalyst, with or without promoters, may be used to facilitate the reaction. See, for example, U.S. Pat. No. 5,844,115, which is incorporated herein by reference in its entirety. Such are well known to those skilled in the art without further instruction. The desired alkoxylation may be conveniently carried out as a batch, semi-batch, or continuous operation.

The resulting cycloalphatic amine alkoxylate may, in particular embodiments, be conveniently selected from cycloaliphatic diamine propoxylates and butoxylates, wherein the molar ratio of alkoxylate to cycloaliphatic diamine ranges from 2:1 to 20:1; preferably from 3:1 to 20:1; more preferably from 5:1 to 20:1; and most preferably from 5:1 to 10:1. Suitable examples may include, but are not limited to, 1,2-cyclohexane diamine propoxylate having a propylene oxide content from 5 to 10 moles per mole of 1,2-cyclohexane diamine; 1,2-cyclohexane diamine butoxylate having a butylene oxide content from 5 to 10 moles per mole of 1,2-cyclohexane diamine; and combinations thereof.

Useful base oils may be selected from a wide variety of polyalkylene glycols, polyalphaolefins, naphthenic compounds, and combinations thereof. Where a polyalkylene glycol is selected, such may be selected such that it is miscible with the antioxidant additive and preferably has a kinematic viscosity ranging from 15 to 100 centistokes (cSt) at 40° C. In certain particular embodiments the polyalkylene glycol is a polypropoxylate (100 percent propylene oxide) initiated on a monol, diol or higher alcohol; a polybutoxylate (100 percent butylene oxide) initiated on a monol, diol, or higher alcohol; a random or block copolymer of propylene oxide and butylene oxide; or a random copolymer of ethylene oxide and propylene oxide. An example may include SYNALOX™ 100-20B, 100-30B, 100-40B or 100-50B, available from The Dow Chemical Company. Alternative choices may include UCON™ LB-135, LB-165 or LB-285, also available from The Dow Chemical Company. All of these products are based on a monol initiator (such as butanol) which has been propoxylated using propylene oxide such that the base oil contains 100 propylene oxide monomer units. In general it may be desirable to avoid relatively hygroscopic polymers.

In certain embodiments a polyalphaolefin may be selected as the base oil. Polyolefins are typically manufactured from C8 to C14 olefins, and the result is generally combinations of dimers, trimers, tetramers, pentamers, and so forth. The polyalpha-olefin may be selected from any that has a kinematic viscosity at 100° C. that is less than 15 cSt (0.000015 $m^2$/second), a kinematic viscosity at 40° C. that is less than 100 cSt (0.0001 $m^2$/second), a viscosity index greater than 120 and a pour point that is less than −10° C. Kinematic viscosity is measured according to ASTM International's (ASTM) test method D-445, and pour point is measured according to ASTM D-97. In certain desirable embodiments the selected polyalphaolefin has a pour point that is less than −60° C. Examples may include isoparaffinic synthetic NEXBASE™ 2004 polyalphaolefins, available from Neste Oil N.V. in Belgium; SYNFLUID™ PAO-4, available from Chevron Phillips; and DURASYN™ 164 available from Ineos Group Limited. SYNFLUID™ PAO-4 has a kinematic viscosity at 100° C. of 4 cSt and a pour point of −69° C. DURASYN™ 164 has a kinematic viscosity at 100° C. of 2 cSt and a pour point of less than −55° C.

A naphthenic oil may also be selected as the base oil. A naphthenic oil is defined herein as any oil wherein a cyclic hydrocarbon (i.e., a cycloalkane, alternatively labeled a naphthene) forms at least 40 percent by weight thereof. Thus, it contains at most 60 percent by weight paraffins, i.e., n-alkanes, if any. As a general rule naphthenic oils have lower pour points than paraffinic oils, and also offer the advantage of generally degrading into products that are soluble in the oils, which leads to fewer problems related to formation of sludges and deposits. Cycloalkanes consist of only carbon (C) and hydrogen (H) atoms and are saturated because there are no multiple C—C bonds to hydrogenate (add more hydrogen to). A general chemical formula for the cycloalkanes herein is $C_nH_{2(n+1-g)}$ where n=number of C atoms and g=number of rings in the molecule.

Most conveniently the naphthenic oils may be obtained from petroleum. For example, mineral oil, which is the liquid by-product of the distillation of petroleum to produce gasoline and other petroleum-based products from crude oil, may be refined to separate the naphthenic fraction from paraffinic and aromatic fractions. Cycloalkanes with a single ring are named analogously to their normal alkane counterpart of the same carbon count: Cyclopropane, cyclobutane, cyclopentane, cyclohexane, and the like. The larger cycloalkanes, with greater than 20 carbon atoms, are typically called cycloparaffins. Cycloalkanes are classified into small, common, medium, and large cycloalkanes, where cyclopropane and cyclobutane form the "small" category; cyclopentane, cyclohexane, cycloheptane are classified as members of the "common" category; cyclooctane through cyclotridecane are classified in the "medium" category; and all other cycloalkanes are classified as members of "large" category. In certain embodiments it is desirable to employ a naphthenic oil categorized as "common," i.e., having from 5-7 carbon atoms, while in other embodiments a "medium" category cycloalkane, i.e., having from 8-13 carbon atoms, may be preferred.

Combinations of some or all of the above types of oils may also be employed as the base oil used in the inventive compositions. Additional oils may also be included, provided such do not represent more than 50 weight percent (wt %) of the total base oil. Such additional oils may be selected from polythio-ether-polyols, polyester-amides, hydroxyl-containing polyacetals and hydroxyl-containing aliphatic polycarbonates, and preferably polyester-polyols and polyether-polyols. Other selections may include combinations of the above and other polyhydroxyl compounds having hydroxyl numbers of less than 100. However, it is important that the cycloaliphatic amine alkoxylate(s) used as an antioxidant additive be fully miscible with the base oil, and therefore it must be miscible with any selected combination of base oils. As used herein, the term "miscible" is defined as exhibiting a single phase, based upon visual inspection, after mixing at a shear rate of from 100 revolutions per minute (rpm) to 200 rpm for from 10 to 20 minutes (min) followed by standing for a period of at least 24 h at ambient temperature and at atmospheric pressure.

To illustrate the miscibility that is desirable in the invention, for example, 475 g of UCON™ OSP-46 may be added to a one-liter (1-L) PYREX™ beaker and 25 g of CHDA-10PO may be added thereto. The mixture is then heated to 40° C. and stirred at 100 rpm for 10 min until the mixture is clear and homogeneous. The product is then allowed to cool to ambient temperature (25° C.) and is visually inspected after 24 h. At this point the product appears to be a clear, homogeneous solution. The combination of the UCON™ and CHDA-10PO, as combined hereinabove, is deemed "miscible" as the term is used herein.

The amount of the cycloaliphatic amine alkoxylate in the lubricant composition may vary, but in certain particular embodiments it desirably ranges from 100 parts per million (ppm) up to 5 wt %. More particularly it may range from 1 wt % to 5 wt %. In certain especially preferred embodiments it may range from 1 wt % to 3 wt %.

The inventive compositions may contain additional components such as may be desirable in order to tailor the compositions to their ultimate applications. For example, the lubricant blend compositions may also include one or more conventional lubricant additives in addition to the base oil selections specified hereinabove. Such additives may include defoamers such as polymethylsiloxanes; demulsifiers; other antioxidants such as, for example, phenolic antioxidants, hindered phenolic antioxidants, additional sulfurized olefins, secondary amine antioxidants, sulfurized phenolic antioxidants, oil-soluble copper compounds, and mixtures thereof; copper corrosion inhibitors; rust inhibitors; pour point depressants; detergents; dyes; metal deactivators; supplemental friction modifiers; diluents; combinations thereof; and the like. The conventional lubricant additives, if present, typically range from 100 parts by weight per million parts by weight (ppm) of lubricant composition, up to 5 wt % based upon total lubricant composition weight. For example, corrosion inhibitors may be added in an amount preferably ranging from 0.05 to 3 wt %, more preferably from 0.1 to 0.25 wt %, based on total composition weight, in order to reduce any degradative interaction between the lubricant composition and any metals with which it comes into contact.

Preparation of the inventive compositions may be carried out using any means and/or method known or envisioned by those skilled in the art, provided that the combination ensures homogeneity of the components in general, and particularly of the base oil and the cycloaliphatic amine alkoxylate. The compositions may be prepared in batch, semi-batch or continuous fashion, preferably in mixing vessels capable of exerting sufficient shear to homogenize the compositions, thereby assuring a single phase. Temperature is desirably in the range of from 20° C. to 60° C., more preferably from 30° C. to 50° C., and pressure may conveniently be at or near atmospheric (1 atm, approximately 101 kPa.

For many applications it is desirable that the final lubricant compositions, immediately following completion of mixing, exhibit a kinetic viscosity at 40° C., according to ASTM D7042, ranging from 10 to 1000 cSt, preferably from 20 to 400 cSt, and most preferably from 30 to 100 cSt. These viscosity ranges may be useful for a wide range of applications, including, for example, transmission fluids, hydraulic oils, compressor fluids, gear oils, and the like.

A particular advantage of the inventive compositions is that they may be formulated to exhibit a viscosity change of less than 5 percent after 13 days at 120° C. using ASTM D2893B methodology that includes air, dried by passing through a dessicant, at a flow rate of 10 L/h. This minimized viscosity change is indicative of a thermoxidative stability that is improved in comparison with base oils which do not contain an antioxidant or indeed some base oils which also contain an antioxidant. For example, when this test is conducted using a polyalphaolefin base oil, such as NEXBASE™ 2004 that does not contain an antioxidant, a viscosity change of 174% is observed (see Table 2), which constitutes a "fail" rating according to a modified ASTM D-2893B test protocol as described in the Examples hereinbelow. Other base oils, such as vegetable oil, generally also receive a "fail" rating when a phenolic antioxidant is included. For example, a canola oil containing 1 wt % IRGANOX™ L101 shows a 408% increase in viscosity. In contrast, the inventive compositions may exhibit a viscosity change of less than 5 percent under the same conditions of temperature, time and humidity, thus earning them a "pass" rating under the same test protocol. Thus, the inventive compositions may be useful under relatively extreme conditions for relatively extended time periods, thereby potentially reducing costs associated with downtime, lubricant replacement, equipment maintenance and repair, and the like.

EXAMPLES

The materials used in the Examples and Comparative Examples and obtained commercially include:

- TOTAL™ 150 S.N. (Solvent Neutral): A Group I paraffinic solvent neutral base oil available from Total Corporation and having a typical kinematic viscosity of 30 square millimeters per second ($mm^2$/sec) at 40° C.
- SYNALOX™ 100-30B: A butanol-initiated propoxylate having a typical kinematic viscosity of 46 $mm^2$/sec at 40° C., available from The Dow Chemical Company.
- NYNAS™ T22: A naphthenic base oil from Nynas Corporation, having a typical kinematic viscosity of 22 $mm^2$/sec at 40° C. and a density at 15° C. of 0.90 grams per milliliter (g/mL). It has a naphthenic content of 42 wt %; an aromatic content of 11 wt %; and a paraffinic content of 47 wt %.
- NEXBASE™ 2004: A polyalphaolefin base oil from Neste having a typical kinematic viscosity of 4 $mm^2$/sec at 100° C.
- UCON™ OSP-46: A dodecanol-initiated propylene oxide/butylene oxide (PO/BO) (50/50 weight/weight, ww), available from The Dow Chemical Company.
- IRGANOX™ L57: An aromatic-based amine antioxidant, available from BASF.
- IRGANOX™ L101: An aromatic-based phenolic antioxidant, available from BASF.
- IRGANOX™ L109: An aromatic-based phenolic antioxidant, available from BASF.

Preparation of Cycloaliphatic Amine Alkoxylate Compounds:

Also used in the Examples and Comparative Examples are two propoxylated cycloaliphatic amine compounds, including 1,2-cyclohexanediamine propoxylated with 5 moles of propylene oxide (PO) per mole of 1,2-cyclohexanediamine, referred to herein as CHDA-5PO; and 1,2-cyclohexanediamine propoxylated with 10 moles of PO per mole of 1,2-cyclohexanediamine, referred to herein as CHDA-10PO. These are prepared, along with a product wherein 1,2-cyclohexanediamine is propoxylated with 3 moles of PO per mole of 1,2-cyclohexanediamine (CHDA-3PO), as follows.

To a reactor purged with nitrogen, an amount of 1,2-cyclohexanediamine (4,000 grams (g), 35.1 moles (mol)) is added. The reaction vessel is heated to 125° C. prior to feeding of PO (6,105 g, 105 mol). Once the feeding step is completed the reaction is allowed to digest for a period of 120 minutes (min), after which point a sample (designated as CHDA-3PO) is taken for analysis.

A solution of potassium hydroxide (KOH, 22.2 g, 45 wt %) is then added and the excess water removed under vacuum. The reactor temperature is increased to 125° C. and charged with PO (3,990 g, 69 mol), and then allowed to digest for a period of 240 min. Another sample of product is taken (7,000 g) (designated as CHDA-5PO) and neutralized by the addition of a solution of acetic acid (70 wt %) with the product produced isolated as a transparent, slightly yellow, highly viscous liquid (hydroxyl number, OH# is 502 milligrams of KOH per gram of product, mg KOH/g), viscosity at 50° C. of 13,200 millipascals·seconds (mPa·s).

To the remaining product in the reactor a further addition of PO (4,949 g, 85.2 mol) is completed and allowed to digest for a period of 60 min at 125° C. After this time a solution of acetic acid (70 wt %) is added with the product produced isolated as a transparent, slightly yellow, viscous liquid (OH# is 313 mg KOH/g, viscosity at 50° C. is 675 mPa·s). A final sample is taken and designated as CHDA-10PO. The following Table 1 shows the characterization of the three samples as analyzed by means of protonic nuclear magnetic resonance ($^1$H NMR) testing.

TABLE 1

Properties of non-aromatic cycloalphatic amine alkoxylates.

| Sample CHDA+ × PO | 3 PO | 5 PO | 10 PO |
|---|---|---|---|
| Functionality mole OH | 2.7 | 3.6 | 3.7 |
| Total PO added | 2.8 | 5 | 10 |
| Mole NH | 1.3 | 0.4 | 0.3 |
| Mole PO as chain PO | 0.1 | 1.5 | 6.3 |
| Mole PO as end-PO | 2.7 | 3.6 | 3.7 |

Thermoxidative Stability Testing:

Testing is done according to a modified version of the ASTM D-2893B test method. As applied hereunder, 300 ml of each sample, contained in a borosilicate glass tube, is heated to 120° C. in dry air for 312 h (13 days). The kinematic viscosity of the sample at 40° C. (KV40) is measured according to the method of ASTM D7042. Under the modified ASTM D-2893 test, a "pass" rating is accorded to a composition if the sample exhibits a viscosity change of less than 5% after 13 days.

Examples 1-7 and Comparative Examples A-K

Formulation Preparation:

Compositions of formulations prepared and evaluated are shown in Table 2. All percentages shown are by weight. A total of 500 g of each formulation is prepared in a 1 liter (L) glass beaker fitted with an electric stirrer to provide adequate mixing. The formulations containing more than one component are prepared by first charging the beaker with the component representing the greatest amount, i.e., the component that is used in the highest weight percent, and then adding the other components thereto. Stirring is carried out at ambient temperature until the formulations are clear and homogeneous; compositions that are determined to be non-homogeneous are indicated in the Table 2 but are not evaluated for thermoxidative stability. Formulations containing IRGANOX™ L101 and L109 are heated to 60° C. until the composition is clear and homogeneous and then cooled to ambient temperature.

In Table 2 a virgin base oil is marked as a "Reference" product. Products containing base oil and aromatic antioxidants (under the tradename IRGANOX™) are marked as Comparative Examples. Products containing the cycloaliphatic amine alkoxylates and meeting the criteria to be accorded a "pass" rating are marked as Examples. Products containing the cycloaliphatic amine alkoxylates and receiving a "fail" rating are marked as Comparative Examples. The cycloaliphatic amine alkoxylates CHDA-5PO and CHDA-10PO are included in compositions at concentrations indicated as 1 wt % and 5 wt %.

TABLE 2

Oxidation Performance of Lubricant Compositions.

| Antioxidant Composition | KV40 Initial mm$^2$/sec | KV40 Final mm$^2$/sec | % KV40 change | PASS or FAIL | Sample Designation | Comments |
|---|---|---|---|---|---|---|
| 150 S.N.-100% | 29.9 | 29.5 | 1.2 | PASS | Reference | |
| 150 S.N.-99.5% IRGANOX L109-0.5% | 28.9 | 30.5 | 5.5 | FAIL | Comparative Example A | Containing aromatic antioxidant |
| 150 S.N.-95% CHDA-10PO-5% | 30.4 | 31.3 | 3.0 | PASS | Example 1 | See note A below |
| NEXBASE 2004-100% | 17.7 | 48.7 | 176 | FAIL | Reference | |
| NEXBASE 2004-99.5% IRGANOX L109-0.5% | 18.1 | 18.3 | 1.3 | PASS | Comparative Example B | Containing aromatic antioxidant |
| NEXBASE 2004-79.5% IRGANOX L109-0.5% UCON OSP-46-20% | 20.4 | 20.0 | 2.1 | PASS | Comparative Example C | Containing aromatic antioxidant |
| NEXBASE 2004-95% CHDA-10PO-5% | insoluble | — | — | | Comparative Example D | |
| NEXBASE 2004-80% UCON OSP-46-20% | 19.8 | 30.5 | 54.1 | FAIL | Reference | |
| NEXBASE 2004-75% UCON OSP-46-20% CHDA-10PO-5% | 21.5 | 21.4 | 0.5 | PASS | Example 2 | |
| NYNAS T22-100% | 20.7 | 22.4 | 8.0 | FAIL | Reference | |
| NYNAS T22-99% IRGANOX L101-1% | 21.6 | 21.7 | 0.4 | PASS | Comparative Example E | Reference example containing aromatic antioxidant |
| NYNAS T22-95% CHDA-10PO-5% | insoluble | — | — | | Comparative Example F | |
| NYNAS T22-99% CHDA-10PO-1% | 21.0 | 22.0 | 4.8 | PASS | Example 3 | |
| NYNAS T22-95% CHDA-5PO-5% | 24.6 | 23.6 | 4.0 | PASS | Example 4 | |
| SYNALOX 100-30B-100% | 44.8 | 18.2 | 59.4 | FAIL | Reference | |
| SYNALOX 100-30B-99% IRGANOX L57-1% | 46.1 | 46.6 | 1.0 | PASS | Comparative Example G | Containing aromatic antioxidant |

TABLE 2-continued

Oxidation Performance of Lubricant Compositions.

| Antioxidant Composition | KV40 Initial $mm^2/sec$ | KV40 Final $mm^2/sec$ | % KV40 change | PASS or FAIL | Sample Designation | Comments |
|---|---|---|---|---|---|---|
| SYNALOX 100-30B-95% CHDA-10PO-5% | 48.6 | 47.8 | 1.5 | PASS | Example 5 | |
| SYNALOX 100-30B-99% CHDA-10PO-1% | 44.3 | 24.6 | 44.7 | FAIL | Comparative Example H | |
| SYNALOX 50-30B-100% | 50.9 | 30.9 | 39.3 | FAIL | Reference | |
| SYNALOX 50-30B-99% IRGANOX L57-1% | 45.7 | 46.7 | 1.5 | PASS | Comparative Example I | Containing aromatic antioxidant |
| SYNALOX 50-30B-95% CHDA-10PO-5% | 55.4 | 54.0 | 2.5 | PASS | Example 6 | |
| UCON OSP-46-100% | 46.0 | 19.0 | 59 | FAIL | Reference | |
| UCON OSP-46-99.5% Irganox L109-0.5% | 46.0 | 44.3 | 3.8 | PASS | Comparative Example J | Containing aromatic antioxidant |
| UCON OSP-46-95% CHDA-10PO-5% | 50.7 | 50.8 | 0.13 | PASS | Example 7 | |
| UCON OSP-46-99% CHDA-10PO-1% | 43.4 | 21.2 | 51.0 | FAIL | Comparative Example K | |

Note A) The virgin base oil alone and the base oil containing the amine alkoxylate additive both pass this test. The effect of the amine alkoxylate additive is difficult to measure, because this type of base oil is a Group I base oil which contains naturally occurring antioxidants which provide an inhibitory effect.

Comparative Examples L-Q

A solubility study is prepared using 1 wt % and 5 wt % amount of an amine-initiated polyalkylene glycol as described in WO 00/23648, incorporated with the same selection of base oils as used in Examples 1-7 and Comparative Examples A-K. The results are shown in Table 3. These Comparative Examples L-Q illustrate that the combination of these Group I and Group IV base oils with an amine-initiated polyalkylene glycol results in an insoluble product, making further testing pointless.

TABLE 3

Solubility study of an example of an amine-initiated PAG described in WO 00/23648.

| | KV40 Initial $mm^2/sec$ | Sample Designation |
|---|---|---|
| NEXBASE 2004-99% TEA-EO/PO-1% | insoluble | Comparative Example L |
| NYNAS T22-99% TEA-EO/PO-1% | insoluble | Comparative Example M |
| 150 S.N.-99% TEA-EO/PO-1% | insoluble | Comparative Example N |
| NEXBASE 2004-95% TEA-EO/PO-5% | insoluble | Comparative Example O |
| NYNAS T22-95% TEA-EO/PO-5% | insoluble | Comparative Example P |
| 150 S.N.-95% TEA-EO/PO-5% | insoluble | Comparative Example Q |

What is claimed is:

1. A lubricant composition comprising a cycloaliphatic amine alkoxylate and a base oil selected from (a) a polyalkylene glycol; (b) a polyalphaolefin; (c) a naphthenic compound; and (d) combinations thereof; provided that the cycloaliphatic amine alkoxylate and the base oil are miscible, and wherein the cycloaliphatic amine alkoxylate is selected from the group consisting of 1,2-cyclohexane diamine propoxylate having a propylene oxide content from 5 to 10 moles per mole of 1,2-cyclohexane diamine; 1,2-cyclohexane diamine butoxylate having a butylene oxide content from 5 to 10 moles per mole of 1.2-cyclohexane diamine; and combinations thereof.

2. The lubricant composition of claim 1 wherein the lubricant composition exhibits a viscosity change of less than 5 percent (%) after 13 days at 120° C. in dry air, according to viscosity testing carried out at 40° C. under ASTM D7042.

3. The lubricant composition of claim 1 wherein the base oil is a Group II, or III base oil, as categorized according to the American Petroleum Institute.

4. The lubricant composition of claim 1 wherein the cycloaliphatic amine alkoxylate is present in an amount ranging from 100 parts per million to 5 weight percent.

5. A method of making a lubricant composition comprising combining at least a cycloaliphatic amine alkoxylate and a base oil selected from (a) a polyalkylene glycol; (b) a polyalphaolefin; (c) a naphthenic compound; and (d) combinations thereof; under conditions such that the cycloaliphatic amine alkoxylate and the base oil are miscible, wherein the cycloaliphatic amine alkoxylate is selected from the group consisting of 1,2-cyclohexane diamine propoxvlate having a propylene oxide content from 5 to 10 moles per mole of 1,2-cyclohexane diamine; 1,2-cyclohexane diamine butoxylate having a butylene oxide content from 5 to 10 moles per mole of 1,2-cyclohexane diamine; and combinations thereof.

6. The method of claim 5 wherein the cycloaliphatic amine alkoxylate is prepared by reacting the amine initiator with an alkoxide selected from propylene oxide, butylene oxide, and combinations thereof; under conditions suitable to form a cycloaliphatic amine alkoxylate.

7. The method of claim 5 wherein the cycloaliphatic amine alkoxylate is present in the lubricant composition in an amount ranging from 100 parts per million to 5 weight percent.

8. The method of claim 5 wherein the cycloaliphatic amine alkoxylate is present in the lubricant composition in an amount ranging from 1 weight percent to 5 weight percent.

* * * * *